US005776020A

United States Patent [19]

Barone

[11] Patent Number: 5,776,020

[45] Date of Patent: Jul. 7, 1998

[54] TENSIONING DEVICE FOR SPORTING RACQUETS

[76] Inventor: Michael A. Barone, 4 Bonaire Blvd., Delray, Fla. 33446

[21] Appl. No.: 858,423

[22] Filed: May 19, 1997

[51] Int. Cl.[6] ..... A63B 51/00

[52] U.S. Cl. ..... 473/522

[58] Field of Search ..... 473/520, 521, 473/522, 178

[56] References Cited

U.S. PATENT DOCUMENTS

| | | | |
|---|---|---|---|
| 4,761,007 | 8/1988 | Boschian | 473/522 |
| 4,909,509 | 3/1990 | Boschian | 473/522 |
| 4,927,143 | 5/1990 | Hillock | 473/522 |
| 5,106,086 | 4/1992 | Acosta | 473/522 |
| 5,137,769 | 8/1992 | Landi | 473/522 |

FOREIGN PATENT DOCUMENTS

| | | | |
|---|---|---|---|
| 3443009 | 5/1986 | Germany | 473/178 |
| 3504137 | 8/1986 | Germany | 473/178 |

*Primary Examiner*—William E. Stoll
*Attorney, Agent, or Firm*—Pennie & Edmonds LLP

[57] ABSTRACT

The present invention relates to a tensioning device for dampening vibrations generated in a striking surface of a sporting racquet. The tensioning device has a tubular body portion having cylindrical outer and inner walls and two end surfaces. The cylindrical outer wall has a diameter substantially equal to a spacing formed by two generally parallel strings of the sporting racquet. A dampening unit is disposed inside the tubular body portion. The dampening unit has a center post substantially concentric with the tubular body portion and plural leaf members connecting the center post to the inner wall of the tubular body portion. The tensioning device also has two sets of flange members extending radially outwardly from the outer wall of the tubular body portion and near the end surfaces respectively. The two sets of flange members define a peripheral channel portion therebetween to accommodate strings of the sporting racquet whereby the tensioning device is retained in place.

20 Claims, 3 Drawing Sheets

TENSIONING DEVICE FOR SPORTING RACQUETS

FIELD OF THE INVENTION

The present invention relates to a tensioning device used for sporting racquets. More specifically, the present invention relates to a tensioning device used for hand-held sporting racquets having a strung striking surface.

BACKGROUND OF THE INVENTION

There has been a great interest in devices which can be attached to strung sporting racquets to improve player performance and, at the same time, to protect the player from sports related injuries. In particular, U.S. Pat. No. 4,609,194 discloses such a device, which is in the form of a foam cylinder. The foam cylinder device can be inserted into the strung striking surface of a racquet so as to dampen some of the vibrations generated in the racquet surface when a ball is struck.

In addition, U.S. Pat. No. 5,022,651 discloses an exercise and training tensioning device used in sporting racquets for changing the vibrations in the striking surfaces of the racquets. The tensioning device comprises a block of a rigid material and has a cut-out mounting groove along its periphery for fitting between adjacent parallel strings.

Conventional devices, however, provide unsatisfactory dampening of the vibrations occurred in the strung racquets. Of the previous devices attached to the racquet surface, those disclosed in U.S. Pat. No. 4,609,194 dampen all the vibrations of the strings without any flexibility in adjusting the degree of dampening or the frequency of the vibrations of the string. Others such as disclosed in U.S. Pat. No. 5,022,651 have limited dampening and can fail to perform the function entirely due to the unreliable engagement between the mounting groove on the device and the strings on the racquet. Hence, none of the conventional devices can ensure the player to optimally balance player performance and player comfort and protection.

Therefore, it has been desirable to develop a device for strung sporting racquets which provides easy installation and removal, selective dampening of the string vibrations and selective adjustment of the frequency of the string vibrations to thus allow a player to better balance player performance and player comfort and protection.

SUMMARY OF THE INVENTION

It is an object of the present invention to provide a tensioning device for sporting racquets having a strung striking surface which perform in a manner superior to prior art exercise and training devices.

It is also an object of the present invention to provide a tensioning device for strung sporting racquets which has a better dampening for the vibrations generated in the racquet surface.

It is a further object of the present invention to provide a tensioning device for strung sporting racquets which can be reliably mounted on the racquet surface.

It is another object of the present invention to provide a tensioning device for strung sporting racquets which can be easily inserted onto and removed from the racquet surface.

It is another object of the present invention to provide a tensioning device for strung sporting racquets which can be placed in any position on the racquet face to provide optional reflection of vibrations.

It is another object of the present invention to provide a tensioning device as an improved weighing system for use with hand-held sporting racquets, tennis racquets, racquet ball racquets, squash or badminton, having a face or striking surface formed of two intersecting sets of generally parallel strings.

In accordance with the above-described objects, the present invention relates to a tensioning device for dampening vibrations generated in a striking surface of a sporting racquet. The tensioning device of the present invention comprises a tubular body portion with an axis having outer and inner walls and two end surfaces. The outer wall has a dimension substantially equal to a spacing formed by two generally parallel strings of the sporting racquet. A dampening unit is disposed inside the tubular body portion and comprises a center post along the axis of the tubular body portion and a plurality of leaf members connecting the center post to the inner wall of the tubular body portion. The tensioning device of the present invention further comprises two sets of flange members extending radially outwardly from the outer wall of the tubular body portion and near the end surfaces respectively. The two sets of flange members define a peripheral channel member therebetween to accommodate strings of the sporting racquet whereby the tensioning device is retained in place.

According to the tensioning device of the present invention, the leaf members in the dampening unit are evenly distributed. The leaf members are preferably leaf springs. In a preferred embodiment, there are four leaf members, each of which is a spiral leaf spring.

The two sets of flange members of the tensioning device each include a plurality of flange members. The flange members in each set are evenly distributed along the outer wall of the tubular body portion and staggered with those in the other flange set. In a preferred embodiment, there are four flange members in each flange set. In another embodiment, at least one of the two flange sets forms an integral circular flange member.

In addition, at least one flange member in the flange sets has a stop member located on an inner surface, which faces the channel portion. The stop member and the outer wall of the tubular body portion define a gap portion therebetween to reliably retain the string of the sporting racquet. In a preferred embodiment, the stop member is a boss member protruding from the inner surface towards the channel portion.

The tubular body portion of the tensioning device can further comprise a plurality of slot members extending radially from the inner wall in the tubular body portion. In a preferred embodiment, there are four slot members evenly distributed in the tubular body portion.

The present invention relates to a tensioning device for dampening vibrations generated in a striking surface of a sporting racquet. The tensioning device comprises a cylindrical disk unit with an axis having a peripheral wall and two end surfaces. A plurality of cut-out portions are formed in the disk unit extending between the two end surfaces of the disk unit. A plurality of leaf members are provided to divide the cut-out portions and intersect at the axis of the disk unit. The tensioning device of the present invention further comprises a peripheral channel portion formed on the peripheral wall of the disk unit for accommodating strings of the sporting racquet whereby the tensioning device is retained in place.

The present invention also relates to a combination of a strung sporting racquet having a striking surface and a tensioning device mounted on the striking surface of the sporting racquet for dampening vibrations generated in the striking surface. The tensioning device therein can be one as described hereinabove. In addition, the tubular body portion of the tensioning device can have an axial length such that the end surfaces of the tubular body portion approximately is flush with the face of the sporting racquet.

A preferred material for the tensioning device is polyurethane. Such a material has the desired density and tensioning properties. It is also sufficiently light and flexible that it does not affect the motion of the racquet when the player is attempting to strike the ball.

It has been discovered that the tensioning device of the present invention produces playing results far superior to those achieved with all prior art devices and this device is easily inserted onto the removed from or relocated on the racquet face as desired.

BRIEF DESCRIPTION OF THE DRAWINGS

The present invention will be more fully understood from the following detailed description taken in conjunction with the accompanying drawings, in which.

DETAILED DESCRIPTION OF PREFERRED EMBODIMENTS

Figure 1:
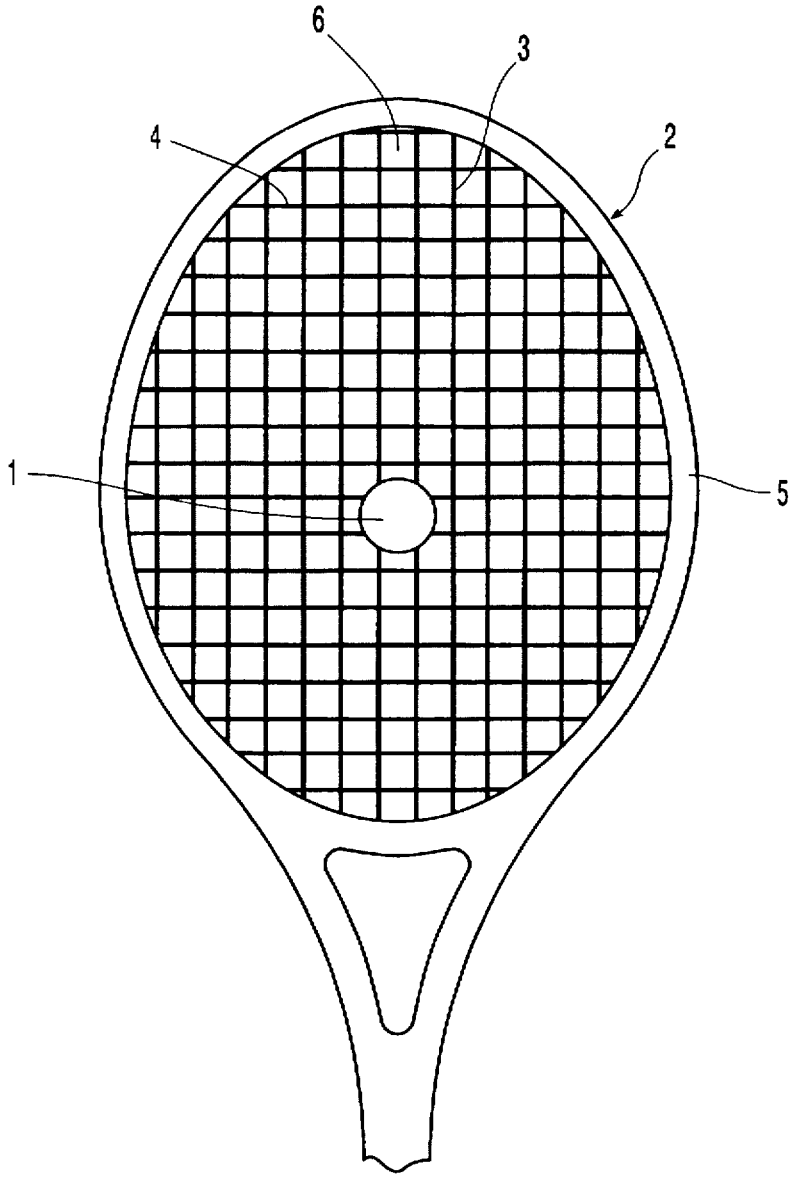
FIG. 1 is a front view of a racquet face showing the tensioning device of the present invention inserted in a center position thereof.

Tensioning devices embodying the principles of the present invention are illustrated in FIGS. 1 to 6. These tensioning devices each include an additional dampening mechanism having a better dampening performance to absorb vibrations generated in a striking surface of a racquet and can be reliably mounted on the racquet. In each embodiment, same elements are designated with same reference numerals and repetitive descriptions are omitted.

FIG. 1 shows a tensioning device 1 being attached to a sporting racquet 2 according to the present invention. The sporting racquet 2 includes two sets of strings 3, 4 interwoven and tensioned on a frame 5 as in conventional racquets. The interwoven strings 3, 4 forms a matrix of spacings 6 for accommodating the tensioning device 1 therein. In FIG. 1, the tensioning device 1 is fitted in a center spacing 6 on the racquet 2. It is understood that the tensioning device 1 can be fitted in any other spacings 6 and that more than one tensioning device 1 can be used.

Figure 2:
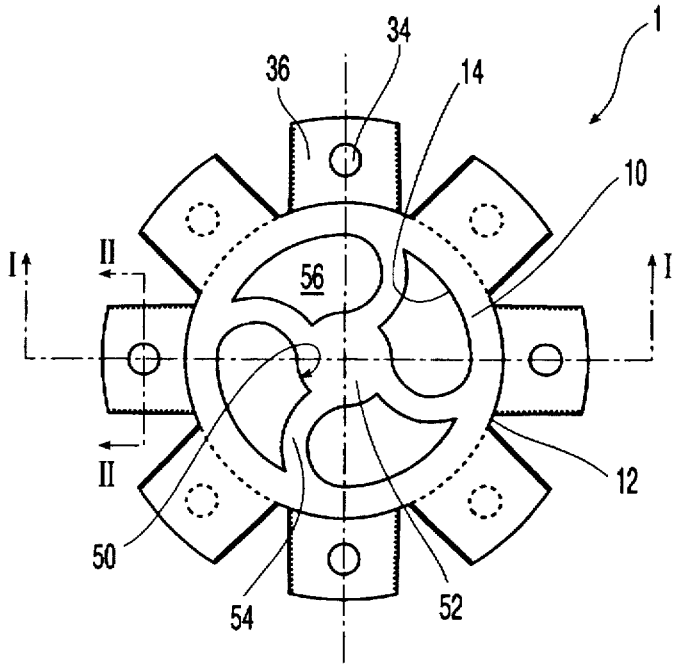
FIG. 2 is a plan view of the tensioning device of the present invention.
Figure 4:
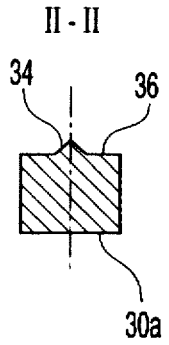
FIG. 4 is a cross-section of the tensioning device of FIG. 2 taken along line II—II.
Figure 3:
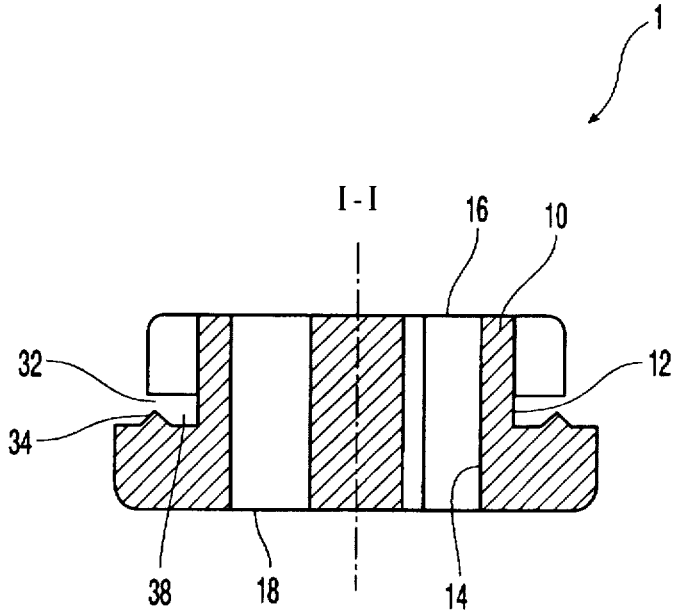
FIG. 3 is a side cross-section of the tensioning device of FIG. 2 taken along line I—I.

Referring to FIGS. 2 through 4, various details of the tensioning device 1 of a first embodiment of the present invention is shown. The tensioning device 1 comprises a tubular body portion 10 with an axis. The tubular body portion 10 is defined by outer and inner walls 12, 14 and two end surfaces 16, 18. In the current preferred embodiment, the tubular body portion 10 is shown having a cylindrical outer wall 12. The diameter of the cylindrical outer wall 12 is substantially equal to a spacing 6 in the sporting racquet 2. Therefore, when the tensioning device 1 is fit in the spacing 6, the outer wall 12 of the tubular body portion 10 contact at least two strings 3, 4 on the sporting racquet 2.

The diameter of the cylindrical outer wall 12 is determined by spacings 6 defined by a first pair of adjacent parallel strings 3 and a perpendicular second pair of adjacent parallel strings 4. More specifically, the diameter of the cylindrical outer wall 12 is designed to fit between a pair of parallel strings 3 or 4 with a smaller distance therebetween. When the racquet 2 has rectangular spacings 6, the outer wall 12 will contact the pair of strings 3 or 4 with a smaller distance and may be one string 4 or 3 in the other pair as well. In case the racquet 2 has square spacings 6, the outer wall 12 will contact both pairs of strings 3 or 4 to absorb vibrations in the racquet 2.

The current preferred embodiment shows that the tubular body portion 10 of the tensioning device 1 has a generally cylindrical disk shape. Nevertheless, the tubular body portion 10 may have many other desired shapes as long as it can fit in a spacing 6 defined by two sets of adjacent strings 3, 4 of the sporting racquet 2. One alternative for the tubular body portion 10 has a square cross-section. Other preferred shapes for the tubular body portion 10 can be those having an oval or a rectangular cross-section. Such a tubular body portion 10 is advantageous for fitting in rectangular spacings 6 on the sporting racquet 2 so that the outer wall 12 thereof can contact all four strings 3, 4 defining the spacing 6 for a better dampening result.

The tensioning device 1 of the present invention further comprises two sets of flange members 30 for removably attaching the tensioning device 1 to the sporting racquet 2. Each of the two flange sets 30 extends radially outwardly from the outer wall 12 of the tubular body portion 10 flush with one end surface 16 or 18. These two sets of flange members 30 define a peripheral channel portion 32 therebetween, which extends perpendicular to the axis of the tubular body portion 10. The channel portion 32 is formed to accommodate strings 3, 4 of the sporting racquet 2 whereby the tensioning device 1 is retained in place.

The two sets of flange members 30 each can include a plurality of flange members 30*a*. The number of the flange members 30*a* in each flange set 30 can range from 2 to 12 and preferably from 4 to 6. In the current preferred embodiment, the tensioning device 1 is shown to have four flange members 30*a* in each flange set 30. In another preferred embodiment as will be discussed in detail hereinafter, the two flange sets 30 each form an integral circular flange member.

The flange members 30*a* in each flange set 30 are preferably evenly distributed along the outer wall 12 of the tubular body portion 10. This arrangement helps the user in orienting the tensioning device 1 on the sporting racquet 2 when using the tensioning device 1. It is also preferred that the flange members 30*a* in one flange set 30 are staggered with those in the other flange set to facilitate the insertion of the tensioning device 1 onto the racquet 2.

Each flange member 30*a* has a length, which is usually measured in a radial direction of the tensioning device 1 and between the outer wall 12 and a remote end of the flange member 30*a*. The length of each flange member 30*a* corresponds to the depth of the channel portion 32 at the same location. Such length or depth is designed to be significantly larger than the dimension of the strings 3, 4. In this manner, the tensioning device 1 can be fit in various racquets 2 with various size spacings 6 as will be discussed in detail hereinafter.

In the current preferred embodiment, all flange members 30*a* are shown to have the same length. Alternatively, the flange members 30*a* can have different lengths. In particular, flange members 30*a* located in one radial direction can have a different length from those in a perpendicular radial direction. This arrangement is advantageous when the spacings 6 on the sporting racquet 2 are rectangular in shape. The flange members 30*a* with a larger length can help retain the pair of strings 3 or 4 with a bigger distance therebetween.

The flange members 30*a* in the current preferred embodiment have a shape of a tab, which is substantially square. Alternatively, the flange members 30*a* can have many different shapes. Other preferred shapes for the flange members 30 can be rectangle, triangle, semicircle or various arch shapes.

In order to ensure the mounting of the tensioning device 1 on the racquet 2, at least one flange member 30*a* in the flange set 30 has a stop member 34 located on its inner surface 36, which faces the channel portion 32. The stop member 34 and the outer wall 12 of the tubular body portion 10 define a gap portion 38 therebetween to reliably retain a string 3 or 4 of the sporting racquet. In this manner, the tensioning device 1 may be lockingly engaged onto the string 3, 4 and not easily become disengaged unless actually removed by the player. Hence, the stop member 34 functions as safety device to ensure that the tensioning device 1 will not become disengaged in use to present a danger to other players in the immediate vicinity.

In a preferred embodiment, the stop member 34 is in the form of a boss member protruding from the inner surface 36 of the flange member 30*a* towards the channel portion 32.

The tensioning device 1 of the present invention features in a dampening unit 50 connected to the inner wall of the tubular body portion 10 to greatly absorb vibrations. The dampening unit 50 comprises a center post 52 arranged substantially concentric with the tubular body portion 10. A plurality of leaf members 54 are provided to connect the center post 52 to the inner wall 14 of the tubular body portion 10. As a result, a plurality of cut-out portions 56 are formed each surrounded by part of the inner wall 14 of the tubular body portion 10, part of the center post 52 and two adjacent leaf members 54.

In the current preferred embodiment, there are four leaf members 54 provided. The leaf members 54 are preferably leaf springs, which are able to considerably absorb vibrations generated in the racquet 2. It is more preferred that the leaf members 54 are spiral leaf springs. Moreover, the leaf members 54 in the dampening unit 50 are preferably evenly distributed. Such arrangement is advantageous for absorbing vibrations in all directions in the recquet 2.

Figure 5:
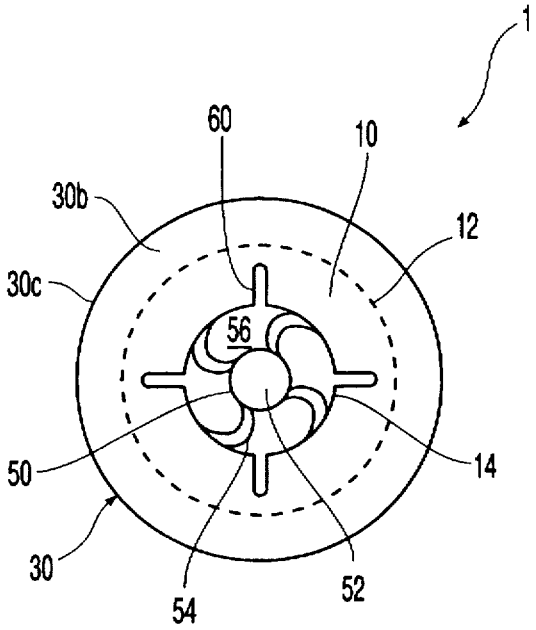
FIG. 5 is a plan view of the tensioning device of an alternative embodiment of the present invention.
Figure 6:
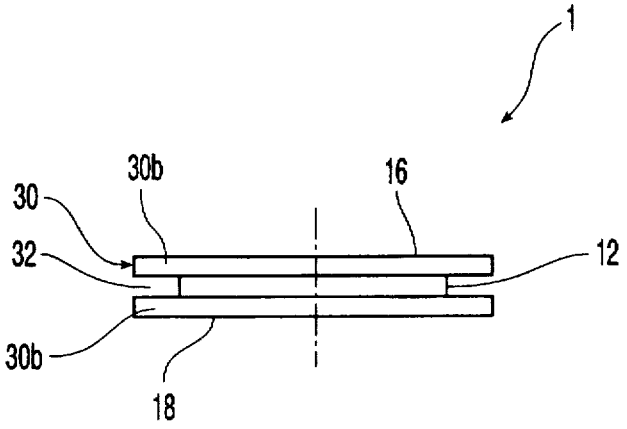
FIG. 6 is a side view of the tensioning device shown in FIG. 5.

Reference is now made to FIGS. 5 and 6 in relation to a second preferred embodiment of the present invention. The tensioning device 1 shown in this preferred embodiment has an integral flange member 30*b* in each flange set 30. The integral flange members 30*b* each have a circular peripheral 30*c* substantially concentric with the axis of the tubular body portion 10. Other shapes such as square, rectangle and oval can also be options for the peripheral 30*c* of each integral flange member 30*b*.

To further absorb vibrations generated in the racquet 2, at least one slot member 60 can be provided on the tubular body portion 10. Each slot member 60 extends from the inner wall 14 into the tubular body portion 10. In the current preferred embodiment, there are four slot members 60, each of which is radially oriented. It is further preferred that the slot members 60 are evenly distributed in the tubular body portion 10 so as to absorb vibrations generated in all directions.

According to a further preferred embodiment of the present invention, a tensioning device 1 is designed as a cylindrical disk unit with an axis having a peripheral wall 12 and two end surfaces 16, 18. A plurality of cut-out portions 56 are formed in the disk unit extending between the two end surfaces 16, 18 of the disk unit. A plurality of leaf members 54 are provided to divide the cut-out portions 56 and intersect at the axis of the disk unit. It is understood that the number of cut-out portions 56 is the same as that of leaf members 54.

The tensioning device 1 in this preferred embodiment further comprises a peripheral channel portion 32, which is formed on the peripheral wall 12 of the disk unit. The channel portion 32 accommodates strings 3, 4 of the sporting racquet 2 therein whereby the tensioning device 1 is retained in place.

The tensioning device 1 of the present invention can have an axial length such that the end surfaces 16, 18 thereof is flush with the face of the racquet 2.

A preferred material for the tensioning device 1 of the present invention is polyurethane. Such a material has the desired density and tensioning properties required for the dampening performance. It is also sufficiently light and flexible that it does not affect the motion of the racquet 2 when the player is attempting to strike a ball.

Discussion will now be made in relation to mounting the tensioning device 1 of the present invention onto a racquet 2. A typical racquet 2, such as a tennis racquet, has a strung striking surface. The tensioning device 1 can be easily mounted on the racquet 2 by fitting the channel portion 32 on the tensioning device 1 onto adjacent strings 3, 4. The tensioning device 1 may need to be deformed slightly so that the tubular body portion 10 is snugly fit within the spacing 6 defined by adjacent strings 3, 4 to thereby absorb vibrations generated in the racquet 2. As mentioned hereinabove, staggered flange members 30*a* can help in locating the strings 3, 4 into the channel portion 32 when mounting the tensioning device 1 onto the racquet 2.

When fit onto the racquet 2, the tensioning device 1 stays in position till the user removes it. The tensioning device 1 can be easily removed from the racquet 2 by being pushed away from the strings 3, 4.

It is clear that the sporting racquet 2 need not be constructed or modified in any manner in order to accommodate the easy insertion and removal of the tensioning device 1 of the present invention. In other words, the tensioning device 1 of the present invention can be adapted for use in connection with squash, badminton and many others. In this regard, the channel portion 32 with a depth so designed allows the tensioning device 1 of the present invention to apply to various racquets 2 having different size spacings 6.

The tensioning device 1 can be mounted at various positions on the racquet 2. One of the preferred locations on the racquet 2 is in the center of the racquet frame 5 as shown in FIG. 1. Other suggested positions for the tensioning device 1 are to the right and left sides or near the top or bottom sides.

It will be appreciated from the above description that the tensioning device 1 of the present invention has various features and characteristics which render it superior to prior devices. Among many advantages of the present invention, a significant merit is that the tensioning device 1 provides a much better dampening through the use of the dampening unit 50.

Another advantage of the tensioning device 1 is that once the tensioning device 1 is properly installed, it will stay in position during the use thereof with the aid of the stop members 34. A further advantage of the present invention is that the tensioning device 1 may be easily attached to and removed from the racquet 2 after the racquet has been strung. A still further advantage of the present invention is that the tensioning device 1 can be placed in the center of the racquet frame 5 to be used as a target to assist beginners to strike the projectile or ball directly in the center of the racquet frame 5.

The foregoing description is only illustrative of the principle of the present invention. It is to be recognized and understood that the invention is not to be limited to the exact configuration as illustrated and described herein. Accordingly, all expedient modifications readily attainable by one versed in the art from the disclosure set forth herein that are within the scope and spirit of the present invention are to be included as further embodiments of the present invention. The scope of the present invention accordingly is to be defined as set forth in the appended claims.

What is claimed is:

1. The combination of a strung sporting racquet having a striking surface and a tensioning device mounted on the striking surface of the sporting racquet for dampening vibrations generated in the striking surface, the tensioning device comprising:

a tubular body portion having cylindrical outer and inner walls and two end surfaces, the cylindrical outer wall having a diameter substantially equal to a spacing formed by two generally parallel strings of the sporting racquet;

a dampening unit disposed inside the tubular body portion and comprising a center post substantially concentric with the tubular body portion and a plurality of leaf members connecting the center post to the inner wall of the tubular body portion; and two sets of flange members extending radially outwardly from the outer wall of the tubular body portion and near the end surfaces respectively, the two sets of flange members defining a peripheral channel portion therebetween to accommodate strings of the sporting racquet whereby the tensioning device is retained in place.

2. The tensioning device of claim 1 wherein each flange member has an inner surface facing the channel portion, at least one flange member having a stop member on the inner surface to define a gap portion between the outer wall of the tubular body portion and the stop member.

3. The combination of claim 1 wherein the leaf members in the dampening unit are leaf springs.

4. The combination of claim 1 wherein at least one of the two flange sets forms an integral circular flange member.

5. The combination of claim 1 wherein the tubular body portion further comprising a slot portion extending radially from the inner wall in the tubular body portion into the tubular body portion.

6. The tensioning device of claim 1 wherein the tubular body portion has an axial length such that the end surfaces of the tubular body portion are approximately flush with the face of the sporting racquet.

7. A tensioning device for dampening vibrations generated in a striking surface of a sporting racquet comprising:

a tubular body portion with an axis having outer and inner walls and two end surfaces, the outer wall having a dimension substantially equal to a spacing formed by two generally parallel strings of a sporting racquet;

a dampening unit disposed inside the tubular body portion and comprising a center post along the axis of the tubular body portion and a plurality of leaf members connecting the center post to the inner wall of the tubular body portion; and two sets of flange members extending radially outwardly from the outer wall of the tubular body portion and near the end surfaces respectively, the two sets of flange members defining a peripheral channel member therebetween to accommodate strings of the sporting racquet whereby the tensioning device is retained in place.

8. The tensioning device of claim 7 wherein the leaf members in the dampening unit are evenly distributed.

9. The tensioning device of claim 8 wherein the leaf members are leaf springs.

10. The tensioning device of claim 8 wherein there are four leaf members, each being a spiral leaf spring.

11. The tensioning device of claim 7 wherein at least one of the two flange sets forms an integral circular flange member.

12. The tensioning device of claim 7 wherein each of the two flange sets includes a plurality of flange members, the flange members in each set being evenly distributed along the outer wall of the tubular body portion.

13. The tensioning device of claim 12 wherein the flange members in one flange set are staggered with those in the other flange set.

14. The tensioning device of claim 13 wherein there are four flange members in each flange set.

15. The tensioning device of claim 12 wherein each flange member has an inner surface facing the channel member, at least one flange member having a stop member located on the inner surface to define a gap portion between the outer wall of the tubular body portion and the stop member.

16. The tensioning device of claim 15 wherein the stop member is a boss member protruding from the inner surface towards the channel portion.

17. The tensioning device of claim 7 wherein the tubular body portion further comprising at least one slot member extending from the inner wall into the tubular body portion.

18. The tensioning device of claim 17 wherein there are four slot members radially oriented and evenly distributed in the tubular body portion.

19. The tensioning device of claim 7 wherein the tensioning device is made of polyurethane.

20. A tensioning device for dampening vibrations generated in a striking surface of a sporting racquet comprising:

a cylindrical disk unit with an axis having a peripheral wall and two end surfaces;

a plurality of cut-out portions formed in the disk unit extending between the two end surfaces of the disk unit;

a plurality of leaf members dividing the cut-out portions and intersecting at the axis of the disk unit; and a peripheral channel portion being formed on the peripheral wall of the disk unit for accommodating strings of a sporting racquet whereby the tensioning device is retained in place.

* * * * *